US008821712B2

(12) United States Patent
Flint et al.

(10) Patent No.: US 8,821,712 B2
(45) Date of Patent: Sep. 2, 2014

(54) PROCESS FOR TREATING A HEAVY HYDROCARBON FEEDSTOCK AND A PRODUCT OBTAINED THEREFROM

(75) Inventors: Leonard F. Flint, Calgary (CA); Patrick B. Carlson, Calgary (CA); Gareth R. Crandall, Calgary (CA)

(73) Assignee: Statoil Canada Ltd., Calgary (CA)

( * ) Notice: Subject to any disclaimer, the term of this patent is extended or adjusted under 35 U.S.C. 154(b) by 0 days.

(21) Appl. No.: 13/197,655

(22) Filed: Aug. 3, 2011

(65) Prior Publication Data

US 2012/0012503 A1 Jan. 19, 2012

Related U.S. Application Data

(62) Division of application No. 11/273,655, filed on Nov. 14, 2005, now Pat. No. 8,002,968.

(51) Int. Cl.
*C10C 3/06* (2006.01)
*C10G 7/00* (2006.01)

(52) U.S. Cl.
USPC ..... 208/23; 208/22

(58) Field of Classification Search
USPC ..... 208/22, 23, 309, 347
See application file for complete search history.

(56) References Cited

U.S. PATENT DOCUMENTS

| | | | |
|---|---|---|---|
| 3,738,931 | A | 6/1973 | Frankovich et al. |
| 4,035,282 | A | 7/1977 | Stuchberry et al. |
| 4,057,486 | A | 11/1977 | Meadus et al. |
| 4,165,274 | A | 8/1979 | Kwant |
| 4,391,701 | A | 7/1983 | Le Page et al. |
| 4,428,824 | A | 1/1984 | Choi et al. |
| 4,533,462 | A | 8/1985 | Billon et al. |
| 4,728,412 | A | 3/1988 | Soderberg |
| 4,849,361 | A | 7/1989 | Dickakian |
| 4,885,080 | A | 12/1989 | Brown et al. |
| 5,958,365 | A | 9/1999 | Liu |
| 6,054,496 | A | 4/2000 | Crane et al. |
| 6,096,192 | A | 8/2000 | Myers et al. |
| 6,277,269 | B1 | 8/2001 | Myers et al. |
| 6,355,159 | B1 | 3/2002 | Myers et al. |
| 6,530,965 | B2 | 3/2003 | Warchol |
| 6,702,936 | B2 | 3/2004 | Rettger et al. |
| 2003/0131526 | A1 | 7/2003 | Kresnyak et al. |

FOREIGN PATENT DOCUMENTS

| | | | |
|---|---|---|---|
| CA | 2428369 | 11/2004 | |
| CA | 2530148 | 1/2005 | |
| WO | WO 2005/003258 | 1/2005 | |
| WO | WO 2005/085395 | * 9/2005 | ..... C10G 67/00 |

OTHER PUBLICATIONS

Boduszynski, "Characterization of 'Heavy'Crude Components", ACS, 1985, accessed from http://web.anl.gov/PCS/acsfuel/preprint%20archive/Files/30_3_CHICAGO_09-85_0365.pdf.*

Gray, Murray R. Upgrading Petroleum Residues and Heavy Oils. Marcel Dekker, 1994. Chapter 1, pp. 2-6.*

(Continued)

*Primary Examiner* — Renee E Robinson
(74) *Attorney, Agent, or Firm* — Bennett Jones LLP

(57) ABSTRACT

A process for treating a heavy hydrocarbon feedstock is disclosed. The process involves separating the feedstock into a residue component and a light component, the residue component having a lower API gravity than the light component and treating at least a portion of the light component to produce a synthetic transport diluent suitable for combining with at least a portion of the residue component to produce a product which meets applicable criteria for pipeline transport.

14 Claims, 4 Drawing Sheets

(56) References Cited

OTHER PUBLICATIONS

Athabasca Bitumen. Environement Canada, Emergencies Science and Technology Division. no date.*

Shell Canada, "Corridor Pipeline", downloaded from www.shell.ca, undated (3 pages).

U.S. Department of Labor, "OSHA Technical Manual" Section IV: Chapter 2, Petroleum Refining Processes, dated Mar. 1, 2003 (57 pages).

Gray, Murray R., University of Alberta, "Tutorial on Upgrading of Oilsands Bitumen", downloaded from www.ualberta.ca, undated (28 pages).

* cited by examiner

| Typical properties of a Typical Hydrocarbon Feedstock | |
|---|---|
| API gravity | 10° |
| Viscosity [centistokes @ 4° C] | >75,000 |
| Sulphur [% by weight] | 3 - 7 |
| TAN [mq KOH/g] | 1.5 - 3.5 |
| Conradson Carbon [% by weight] | 8 - 15 |
| Nickel + Vanadium [ppm by weight] | 100 - 400 |
| % vol. in typical boiling rangecuts: | |
| less than 200° C | 0 - 5% |
| 200 - 350° C | 10 - 15% |
| 350- 550° C | 30 - 35% |
| > 550° C | 40 - 55% |

| | Feedstock | Residue Component | Light Component | Synthetic Transport Diluent | Pipelineable Product |
|---|---|---|---|---|---|
| Volume [%] | 100 | 50 | 50 | 62.5 | 112.5 |
| Gravity [API] | 10° | 3° | 19° | 55° | 27.7° |
| Viscosity [cstokes @ 4°C] | >75,000 | >1,000,000 | <100 | <5 | <350 |
| Sulphur, %w | 4.6 | 5.8 | 2.8 | 0.005 | 3.15 |
| TAN, mg KOH/g | 1.5 - 3.0 | unknown | little or none | little or none | little or none |
| Conradson Carbon, %w | 12.0 | 22.5 | <2 | <0.01 | 11.8 |
| Metals (Ni & V) [ppm by weight] | 225 | 460 | <2 | <0.1 | 235 |

| | Feedstock | Residue Component | Remaining Residue Component | Light Component | Synthetic Transport Diluent | Pipelineable Product |
|---|---|---|---|---|---|---|
| Volume [%] | 100 | 50 | 32 | 50 | 62.5 | 94.5 |
| Gravity [API] | $10^{0}$ | $3^{0}$ | $3^{0}$ | $19^{0}$ | $55^{0}$ | $33.4^{0}$ |
| Viscosity [cstokes @ 4°C] | >75,000 | >1,000,000 | >1,000,000 | <100 | <5 | <350 |
| Sulphur, %w | 4.6 | 5.8 | 5.8 | 2 .8 | 0.005 | 2.3 |
| TAN, mg KOH/g | 1.5 - 3.0 | unknown | unknown | little or none | little or none | little or none |
| Conradson Carbon, %w | 12.0 | 22.5 | 22.5 | <2 | <0.01 | 9.3 |
| Metals (Ni & V) [ppm by weight] | 225 | 460 | 460 | <2 | <0.1 | 190 |

FIG. 5

| | Feedstock | Residue Component | Remaining Residue Component | Light Component | Synthetic Transport Diluent | Pipelineable Product |
|---|---|---|---|---|---|---|
| Volume [%] | 100 | 50 | 32 | 50 | 55 | 87 |
| Gravity [API] | 10° | 3° | 3° | 19° | 31° | 19.4° |
| Viscosity [cstokes @ 4°C] | >75,000 | >1,000,000 | >1,000,000 | <100 | <5 | <350 |
| Sulphur, %w | 4.6 | 5.8 | 5.8 | 2 .8 | 0.010 | 2.5 |
| TAN, mg KOH/g | 1.5 - 3.0 | unknown | unknown | little or none | little or none | little or none |
| Conradson Carbon, %w | 12.0 | 22.5 | 22.5 | <2 | <0.01 | 9.5 |
| Metals (Ni & V) [ppm by weight] | 225 | 460 | 460 | <2 | <0.1 | 200 |

FIG. 6

PROCESS FOR TREATING A HEAVY HYDROCARBON FEEDSTOCK AND A PRODUCT OBTAINED THEREFROM

CROSS REFERENCE TO RELATED APPLICATIONS

This application is a divisional application of U.S. application Ser. No. 11/273,655 filed Nov. 14, 2005, which is presently pending

FIELD OF THE INVENTION

This invention relates to a process for treating a heavy hydrocarbon feedstock to produce a product which meets applicable criteria for pipeline transport.

BACKGROUND OF THE INVENTION

Alberta and Saskatchewan, along with other areas of the world, have large bitumen reserves, which are exploited to produce heavy hydrocarbon feedstocks. These feedstocks are characterized by high concentrations (from 35%-55% by volume) of asphaltene rich residues, and typically have API gravities of below 20°, which makes them too dense and viscous for transport in existing pipelines.

One possible approach in producing a pipelineable product is to perform a full upgrading of the feedstock to a light, sweet synthetic crude. The synthetic crude typically resembles light, sweet conventional crude oils, and is a pipelineable product that is generally accepted by conventional refineries for further processing. However, full upgrading facilities are costly to set up and operate and in general only operations producing more than 100,000 barrels of feedstock per day will be able to take advantage of economies of scale in practicing full upgrading to a pipelineable synthetic crude.

Another approach is to perform a partial upgrading of the feedstock to reduce the density and/or viscosity to an extent that will permit pipeline transport of the partially upgraded product. One problem associated with partial upgrading is that the bitumen may undergo changes in quality that render them less valuable to a downstream upgrader. The downstream upgrader may also incur increased hydrogen consumption due to the need to add hydrogen when upgrading the partially upgraded feedstock. Furthermore, partial upgrading may produce a product that has a high olefinic content. Olefins are unstable hydrocarbons that are potentially unsuitable for pipeline transport.

Operations producing less than 30,000 barrels of feedstock per day will generally find that full upgrading is not economically viable. These operators may opt to dilute their feedstock with a light condensate, separately produced in gas plant operations. The light condensate, sometimes referred to as "diluent", reduces the viscosity and increases the API gravity of the feedstock to produce a pipelineable product. However, as the volume of heavy hydrocarbon feedstock production has increased, the limited supply of diluent has resulted in increased cost of the diluent, in many cases causing the cost of the pipelined product to exceed the value of the feedstock to downstream upgraders and/or refineries.

Another drawback of using diluents to produce a pipelineable product is that new gasoline specifications limit the value of the diluent to the refinery. The diluent, which may be a very light condensate, may also overload processes used to convert the diluent into gasoline. A more recent trend has been to dilute the feedstock with a similar volume of synthetic crude, which is acceptable for refineries that can handle the special characteristics of the synthetic crude portion. While not currently practiced, a similar impact could be achieved by blending a feedstock with a conventional light crude.

In order to mitigate some of the difficulties associated with using a diluent, the downstream upgrader may recover at least a portion of the diluent that is added by the originating producer and transport the recovered diluent by pipeline, back to the originating producer for reuse. For example, the Corridor Pipeline system in Alberta, Canada transports diluted bitumen from the Muskeg River Mine to the Scotford upgrader over a distance of approximately 450 km using a 24 inch pipeline, which transports 215,000 barrels per day of diluted bitumen. A parallel 12 inch return line is used to transport 65,000 barrels per day of diluent from Scotford back to the Muskeg River Mine for reuse. Clearly, such a return line is costly to set up and operate and may not be economically viable for smaller producers.

There remains a need for processes for treating heavy hydrocarbon feedstocks to produce a product which meets applicable criteria for pipeline transport.

SUMMARY OF THE INVENTION

In accordance with one aspect of the invention there is provided a process for treating a heavy hydrocarbon feedstock. The process involves separating the feedstock into a residue component and a light component, wherein the residue component has a lower API gravity than the light component. By treating at least a portion of the light component to produce a synthetic transport diluent suitable for combining with at least a portion of the residue component, the resulting blend can be designed to meet applicable criteria for pipeline transport.

The process may involve combining an amount of the synthetic transport diluent with an amount of the residue component to produce the product.

The process may involve combining an amount of the synthetic transport diluent, an amount of the residue component, and an amount of an external diluent to produce the product.

Separating the feedstock may involve separating a feedstock having an API gravity which is lower than that which meets applicable criteria for pipeline transport.

Separating the feedstock may involve separating a feedstock having an API gravity of less than about 20° API.

Separating the feedstock may involve separating a feedstock having one or more of the following properties: (a) a viscosity of greater than about 75,000 centistokes; (b) a sulphur content of between about 3% and about 7% by weight; (c) a total acid number (TAN) of between about 1.5 mg and about 3.5 mg KOH/g; (d) a Conradson carbon residue content of between about 8% and about 15% by weight; and (e) a nickel and vanadium content of between about 100 and about 400 parts per million by weight.

Separating the feedstock may involve separating the feedstock into a residue component having an API gravity of between about −20° and about 10°.

Separating the feedstock may involve separating the feedstock into a residue component having an API gravity of between about 0° and about 5°.

Separating the feedstock may involve separating the feedstock into between about 25% and about 75% light component by volume and between about 25% and about 75% residue component by volume.

Separating the feedstock may involve separating the feedstock into approximately equal volumes of the residue component and the light component.

Separating the feedstock may involve distilling the feedstock to produce a residue component and a light component having a temperature cutpoint between about 300° C. and about 550° C.

Separating the feedstock may involve separating the feedstock into a residue component having one or more of the following properties: (a) a sulphur content of between about 6% and about 10% by weight; (b) a Conradson carbon residue content of between about 20% and about 50% by weight; and (c) a nickel and vanadium content of between about 400 and about 600 parts per million by weight.

Separating the feedstock may involve separating the feedstock into a light component having an API gravity of between about 0° and about 30°.

Separating the feedstock may involve separating the feedstock into a light component having an API gravity of between about 10° and about 20°.

Separating the feedstock may involve separating the feedstock into a light component having one or more of the following properties: (a) a viscosity that is substantially lower than that of the feedstock; (b) a sulphur content of between about 2% and about 5% by weight; (c) substantially no Conradson carbon residue content; and (d) substantially no nickel or vanadium.

Treating the light component may involve treating at least a portion of the light component to produce a synthetic transport diluent having an API gravity of between about 20° and about 80°.

Treating the light component may involve treating at least a portion of the light component to produce a synthetic transport diluent having a minimum API gravity of about 30°.

Treating the light component may involve treating at least a portion of the light component to produce a synthetic transport diluent having a viscosity of less than about 5 centistokes.

The process may involve tailoring a composition of the synthetic transport diluent to an amount and composition of the residue component with which it is to be combined, and optionally to an amount and composition of the external diluent with which it is to be combined.

Tailoring the composition of the synthetic transport diluent may involve tailoring the composition of the synthetic transport diluent to the amount and composition of the residue component, and optionally the amount and composition of the external diluent, so that the product has an API gravity of greater than about 19° and a viscosity of less than about 350 centistokes.

Separating the feedstock may involve one or more processes which will substantially preserve the quality of the asphaltenes in the residue component including, but not limited to atmospheric distillation and vacuum distillation. Such processes may also concentrate in the residue component the asphaltenes from the feedstock.

Separating the feedstock may involve one or more processes which will affect the quality of the asphaltenes in the residue component including, but not limited to solvent extraction, solvent deasphalting, and mild thermal processes.

Mild thermal processes used during separating the feedstock may include, but are not limited to, visbreaking.

Treating the light component may involve one or more hydrogen addition processes including, but not limited to hydrocracking and hydrotreating.

Treating the light component may involve one or more processes which do not include hydrogen addition including, but not limited to thermal conversion and catalytic cracking.

The feedstock may include asphaltenes and separating may involve concentrating the asphaltenes in the residue component.

Concentrating the asphaltenes in the residue component may involve separating the feedstock such that a quality associated with the asphaltenes is substantially maintained.

The feedstock may include metals such as nickel and vanadium and separating may involve concentrating the metals in the residue component.

The process may involve diverting a diverted portion of the residue component for use other than in combining with the synthetic transport diluent to produce the product.

Diverting may involve diverting the diverted portion of the residue component for use in generating energy such as by combustion of the diverted portion of the residue component.

Diverting may involve diverting the diverted portion of the residue component for gasification of the diverted portion of the residue component.

Treating of the light component may involve a hydrogen addition process and diverting may involve diverting the diverted portion of the residue component for gasification of the diverted portion in order to generate hydrogen for use in the hydrogen addition process.

Diverting may involve diverting the diverted portion of the residue component for residue concentrating to produce a concentrated residue component and a further light component. The concentrated residue component may be used for such purposes as for generating energy or for gasification. The further light component may be combined with the light component or may be included in the product.

The feedstock may include an admixed component operable to remove sediment and water from the feedstock prior to the separating, and the separating of the feedstock may involve recovering the admixed component from the feedstock for reuse.

In accordance with another aspect of the invention there is provided a pipelineable product obtained from a heavy hydrocarbon feedstock. The product includes an amount of residue component separated from the feedstock and having an API gravity of about −20° to about 10° and an amount of synthetic transport diluent separated from the feedstock and treated to have an API gravity of between about 20° and about 80°.

The pipelineable product may include an amount of external diluent. The external diluent may have an API gravity of between about 20° and about 80°. The external diluent may have a viscosity of less than about 50 centistokes.

The pipelineable product may have an API gravity of at least about 19° and a viscosity of no greater than about 350 centistokes.

The residue component may have a viscosity of greater than about 1,000,000 centistokes.

The synthetic transport diluent may have a viscosity of less than about 5 centistokes.

Other aspects and features of the present invention will become apparent to those ordinarily skilled in the art upon review of the following description of specific embodiments of the invention in conjunction with the accompanying Figures.

BRIEF DESCRIPTION OF THE DRAWINGS

In drawings which illustrate embodiments of the invention,

FIG. 5 is a table of characteristics associated with the processing of a feedstock in accordance with a theoretical second example.

FIG. 6 is a table of characteristics associated with the processing of a feedstock in accordance with a theoretical third example.

DETAILED DESCRIPTION

In this specification, the term "heavy hydrocarbon feedstock" is used to refer to any material which has a substantial hydrocarbon content (including, but not limited to, heavy crude oil or bitumen), and which has characteristics that preclude it from being transported in pipelines due to low API gravity (i.e. high specific gravity) and/or high viscosity.

In this specification, unless otherwise specifically stated, viscosity values are indicated at the temperature of the relevant environment in which the viscosity values are to be measured, such as for example, the operating temperature of a pipeline.

In this specification, API gravities are all stated at 60° F.

In this specification, unless otherwise specifically stated, boiling points or cut points are expressed at atmospheric pressure.

Figures 1, 2:
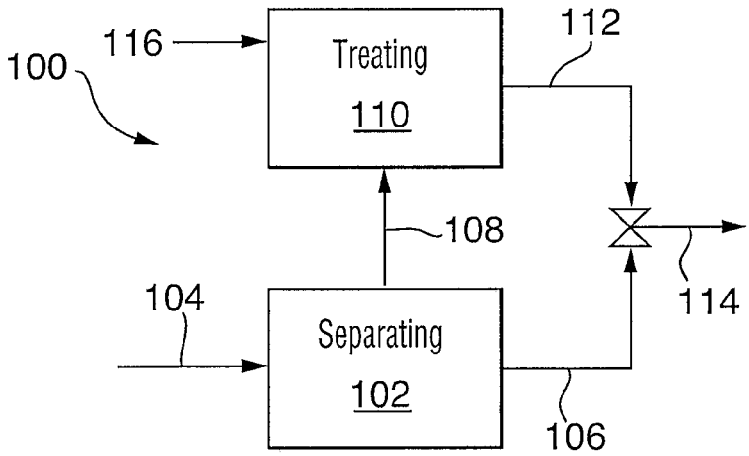
FIG. 1 is a schematic flow diagram of a process according to a first general embodiment of the invention.
FIG. 2 is a table of typical characteristics associated with a typical hydrocarbon feedstock suitable for use in the invention.

Referring to FIG. 1, a process according to a first general embodiment of the invention is shown generally at 100. A heavy hydrocarbon feedstock 104 is subjected to separation 102 into a residue component 106 and a light component 108. The residue component 106 has a lower API gravity than the light component 108. The light component 108 is subjected to treatment 110 to produce a synthetic transport diluent 112 which is suitable for combining with at least a portion of the residue component 106 to produce a product 114 which meets applicable criteria for pipeline transport. The treatment 110 of the light component 108 may include the addition of hydrogen 116 to the light component in a hydrogen addition process.

One typical set of criteria for a product which can be transported by pipeline calls for an API gravity of less than 19° and a maximum viscosity of less than 350 centistokes. However, criteria may vary between different pipelines.

Referring to FIG. 2, typical characteristics are tabulated for a typical heavy hydrocarbon feedstock of the type which is suitable for use in the invention, such as may be produced by extracting bitumen from oil sands in the Cold Lake region of Alberta, Canada. As can be seen from FIG. 2, the typical feedstock has viscosity and API gravity values that do not meet the above indicated criteria for a pipelineable product. The total acid number (TAN) is also sufficiently high to present a potential corrosion issue, which further diminishes the value of the feedstock to the downstream upgrader or refiner.

Figures 3, 4:
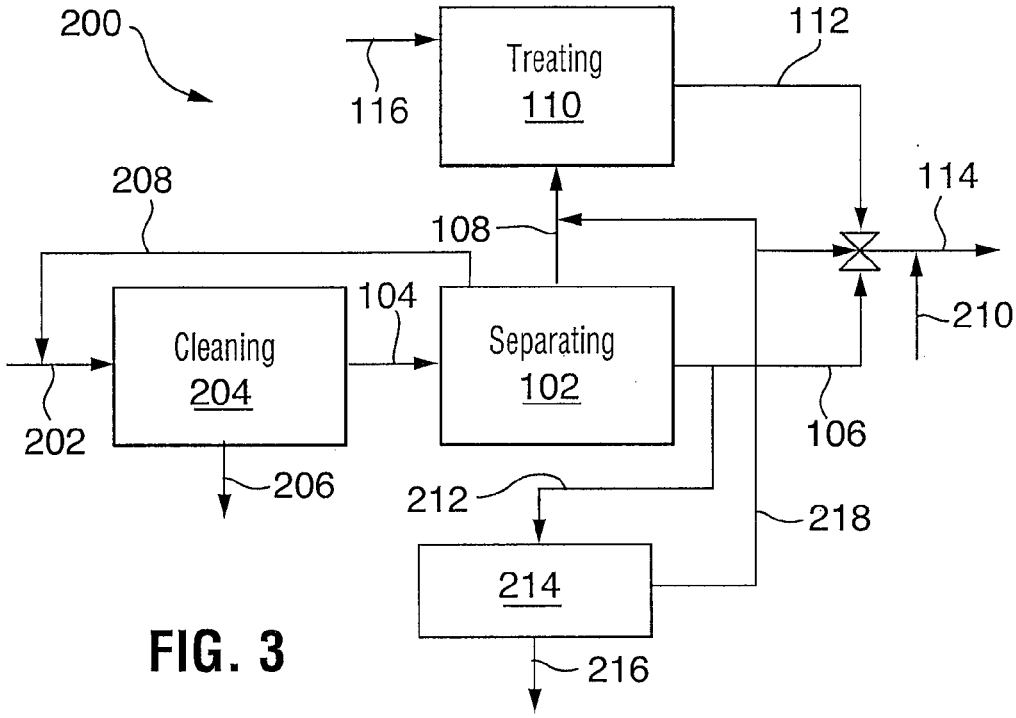
FIG. 3 is a schematic flow diagram of a process according to a second embodiment of the invention.
FIG. 4 is a table of characteristics associated with the processing of a feedstock in accordance with a theoretical first example.

Referring to FIG. 3, a process according to a second embodiment of the invention is shown generally at 200.

As shown in FIG. 3, a raw feedstock 202 is subjected to cleaning 204 to remove water and solids 206, thus producing the feedstock 104. The cleaning 204 may be performed by diluting the raw feedstock 202 with an admixed component. The admixed component may be comprised of either a naphtha solvent or a paraffinic solvent.

The cleaning 204 of the raw feedstock is a process which precedes the process of the invention. As one example, in in situ bitumen recovery, cleaning 204 typically involves diluting the produced fluids exiting the production pipes and separation of the water and solids 206. As a second example, in a mining based recovery operation, the cleaning 204 is often performed in a froth treatment process.

In either case, the result of cleaning 204 is a relatively clean feedstock 104 which is free of most water and solids, but which may also include the admixed component. The admixed component may be recovered from the feedstock 104 in a solvent recovery process, and may then be reused.

The process of the invention is preferably performed using a feedstock 104 which has undergone cleaning 204. The feedstock 104 therefore may or may not include the admixed component, depending upon whether a solvent recovery process has been performed on the feedstock 104 before it is used in the invention. Preferably the admixed component is recovered from the feedstock 104 before the feedstock 104 is used in the process of the invention.

As shown in FIG. 3, the feedstock 104 is subjected to separation 102, which separates the feedstock 104 into the residue component 106 and the light component 108. Where applicable, the separating 102 may optionally also provide a recovered admixed component 208. The recovered admixed component 208 may be recycled and again admixed with the raw feedstock 202 for use in cleaning 204.

The separating 102 includes one or more physical processes which are preferably selected to substantially concentrate the asphaltenes in the residue component 106 and/or substantially preserve the quality of the asphaltenes in the residue component 106 of the feedstock 104. Suitable processes may include a combination of one or more processes including, but not limited to, atmospheric distillation and vacuum distillation.

The separating 102 may also include one or more processes which will affect the quality of the asphaltenes in the residue component 106. Suitable processes may include a combination of one or more processes including, but not limited to, solvent extraction, solvent deasphalting or mild thermal processes such as visbreaking.

For the feedstock 104 described in FIG. 2, the residue component 106 will constitute approximately about 25% to about 75% by volume of the feedstock 104 and will include constituents that have a boiling temperature greater than about 300° C.

The residue component 106 includes substantially all of the asphaltenes from the feedstock 104. The residue component 106 also has a very low API gravity (typically between about −20° and about 10°, and typically between about 0° and about 5°), and has an extremely high viscosity. The residue component 106 may also include a significant portion of the nickel and vanadium from the feedstock 104.

The light component 108 constitutes a remaining portion (approximately about 25% to about 75%) of the feedstock 104. The light component 108 includes lower molecular weight constituents than the residue component 106. These low molecular weight constituents typically have a boiling temperature lower than about 550° C., but may include higher boiling point components if deasphalting is used as one of the separation steps.

The light component 108 typically has an API gravity of between about 0° and about 30°, and typically between about 10° and about 20°, includes substantially no metals such as nickel or vanadium, includes substantially no asphaltenes, and is generally the highest value portion of the feedstock 104.

The light component 108 is subjected to treatment 110 to increase the API gravity and/or lower the viscosity of the light component 108, such that the synthetic transport diluent 112 is produced. All or a portion of the synthetic transport diluent 112 may be combined with at least a portion of the residue component 106, and optionally an amount of an external diluent 210 such as a conventional light condensate from a gas plant, to produce the product 114, which product 114 meets applicable criteria for pipeline transport.

The treatment 110 of the light component 108 may include hydrogen addition processes such as hydrocracking and hydrotreating, and may also include further or alternative processes which do not include hydrogen addition, such as thermal conversion or catalytic cracking. The processes may be further selected to improve other quality attributes associated with the product 114. The treatment 110 may include processes that neutralize acids (i.e. lower the TAN number), remove sulphur, enhance attributes of heavy gas oils or middle distillates, or otherwise enhance the value of the product 114.

The treatment 110 of the light component 108 may also be selected such that the synthetic transport diluent 112 has characteristics that are tailored so that when an amount of the synthetic transport diluent 112 is combined with a desired amount of the residue component 106, and optionally a desired amount of the external diluent 210, the product 114 either just meets, slightly exceeds, or greatly exceeds applicable criteria for pipeline transport.

Accordingly, the synthetic transport diluent 112 may have an API gravity of between 20° and 80°, where the API gravity is specifically tailored for a specific amount of the synthetic transport diluent 112 to be included in the product 114, for a specific composition and amount of the residue component 106 to be included in the product 114, and optionally, for a specific composition and amount of the external diluent 210 to be included in the product 114. For producing most products 114, the synthetic transport diluent 112 preferably has an API gravity of at least about 30°.

As indicated, the composition of the synthetic transport diluent 112 may be tailored to provide a desired composition of the product 114 and/or to reduce or eliminate altogether the need for the external diluent 210 in order to produce the product 114.

In some applications of the invention, a diverted portion 212 of the residue component 106 may not be combined with the synthetic transport diluent 112. Instead, the diverted portion 212 of the residue component 106 may be used for other purposes and/or may be further processed.

For example, the diverted portion 212 of the residue component 106 may be used as a fuel in combustion or some other energy recovery process, which energy may be used in the method of the invention, such as in separation 102 of the feedstock 104 or in treatment 110 of the light component 108, or may be used for some other purpose external to the invention. The diverted portion 212 of the residue component 106 may also be subjected to gasification and used as a source of hydrogen for use in treatment 110 of the light component 108.

In addition or alternatively, and referring to FIG. 3, all or some of the diverted portion 212 of the residue component 106 may be subjected to residue concentrating 214, resulting in conversion of the diverted portion 212 into a concentrated residue component 216 and a further light component 218. The concentrated residue component 216 may be used as a fuel in combustion, or some other energy recovery process, which energy may be used in the invention, such as in separation 102 of the feedstock 104 or treatment 110 of the light component 108, or for some other purpose external to the invention. The concentrated residue component 216 may also be subjected to gasification and used as a source of hydrogen for use in treatment 110 of the light component 108. The further light component 218 may be combined with the light component 108, or may be included in the product 114.

Advantageously, many producers have used natural gas for energy and hydrogen generation, and the use of a portion of the residue component 106 for these purposes may result in substantial cost savings, especially in the purchase of natural gas. Furthermore, by diverting the diverted portion 212 of the residue component 106, the remaining residue component 106, when combined with the synthetic transport diluent 112, may yield a higher value product 114 or facilitate reduced processing of the light component 108 in order to produce a product 114 which meets applicable criteria for pipeline transport.

Further embodiments of the invention are described in relation to the following non-limiting examples.

EXAMPLE 1

A first theoretical example is described with reference to FIG. 4, and illustrates the theoretical processing of a heavy hydrogen feedstock, having characteristics as set forth in FIG. 2. The feedstock has an initial API gravity of about 10°.

The feedstock is first subjected to separation in a deep vacuum flashing process to produce a residue component constituting approximately 50% of the feedstock and a light component constituting the remaining 50% of the feedstock. The residue component has an API gravity of about 3°, and has a substantial portion of the sulphur, Conradson carbon and nickel and vanadium from the feedstock concentrated therein.

The light component is then subjected to treatment in a hydrocracker (with hydrogen added from an external or internal source) to produce a synthetic transport diluent, which in this example is designed as a naphtha rich stream, with a estimated 55° API gravity. The hydrocracking process also adds to the volume of the stream, which increases to approximately 62.5% by volume of the original feedstock, and is essentially free of sulphur and acids.

All of the residue component and all of the synthetic transport diluent are then recombined to produce a product which has an estimated API gravity of about 27.7° and a viscosity lower than about 350 centistokes, and is thus suitable for pipeline transport.

The residue component forms 44% by volume of the product, due to the increase in volume experienced by the light component during its treatment to produce the synthetic transport diluent. At the same time, the residue component quality has been essentially preserved, which may be a desirable attribute of the product.

EXAMPLE 2

A second theoretical example is described with reference to FIG. 5, and illustrates the theoretical processing of a heavy hydrogen feedstock where a diverted portion of the residue component is diverted for an alternative use, such as for thermal energy generation. As in Example 1, the feedstock has an initial API gravity of about 10°.

The feedstock is first subjected to separation in a deep vacuum flashing process to produce a residue component, constituting approximately 50% of the feedstock, and a light component constituting the remaining 50% of the feedstock. A diverted portion of the residue component equal to about 18% of the original feedstock is diverted for the alternative use, leaving a remaining residue component.

The light component is subjected to treatment as in Example 1 to produce a synthetic transport diluent having an API gravity of about 55°. As in Example 1, the volume of the synthetic transport diluent increases due to the treatment of the light component to about 62.5% by volume of the original feedstock.

The remaining residue component is then combined with all of the synthetic transport diluent to produce the product which has an estimated API gravity of about 33.4° and a viscosity lower than about 350 centistokes, and is thus suitable for pipeline transport. The residue component in the pipelineable product now only constitutes about 34% by volume of the pipelineable product, in contrast to Example 1, where the residue component in the pipelineable product constitutes about 45% by volume of the pipelineable product.

EXAMPLE 3

A third theoretical example is described in reference to FIG. 6, and illustrates the theoretical processing of a heavy hydrogen feedstock to just meet applicable criteria for pipeline transport, in this case an API gravity of 19° and a viscosity of 350 centistokes or less. As in Example 2, a portion of the separated residue component is diverted for an alternative use, such as thermal energy generation.

As in Example 1, the feedstock has an initial API gravity of about 10° and the feedstock is first subjected to separation in a deep vacuum flashing process to produce a residue component, constituting approximately 50% of the feedstock, and a light component constituting the remaining 50% of the feedstock.

As in Example 2, a diverted portion of the residue component equal to about 18% of the original feedstock is diverted for the alternative use, leaving a remaining residue component.

The light component is subjected to treatment in a hydrocracker to produce a synthetic transport diluent having an API gravity of about 31°, which is significantly lower than the API gravity of the synthetic transport diluent produced in Examples 1 and 2. The light component is thus processed less than in Examples 1 and 2, and the resulting synthetic transport diluent is more dense and has a correspondingly smaller increase in volume than the synthetic transport diluent in Examples 1 and 2.

The remaining residue component is combined with all of the synthetic transport diluent to produce a product which has an estimated API gravity of about 19.4° and a viscosity lower than about 350 centistokes, so that the product just meets the applicable criteria for pipeline transport. In Example 3, the residue component in the product constitutes about 37% by volume of the product, compared with about 34% in Example 2.

Those skilled in the art of hydrocarbon processes, in view of a set of criteria for pipeline transport of a heavy hydrocarbon feedstock 104, will be able to devise processing schemes for the light component 108 to achieve sufficient treating to meet the criteria in the product 114. Alternatively, the processing of the light component 108 may be more limited and an amount of an external diluent 210 may be included in the product 114 to cause the product 114 to meet applicable criteria for pipeline transport.

Those skilled in the art of hydrocarbon processes will appreciate that other processes, or combinations of processes, in addition to those specifically mentioned herein, may be employed to effect separation of the feedstock 104 into the residue component 106 and the light component 108, and that the components 106,108 may have different proportions, depending on the feedstock 104 and the applicable criteria for pipeline transport. Accordingly, the invention is not limited to the processes specifically mentioned herein for effecting separation of the feedstock 104 into the residue component 106 and the light component 108.

Similarly, those skilled in the art will appreciate that other processes, or combinations of processes, in addition to those specifically mentioned herein, may be employed to effect treatment of the light component 108 to produce the synthetic transport diluent 112, depending upon the required properties and qualities of the synthetic transport diluent 112 and of the product 114. Accordingly, the invention is not limited to the processes specifically mentioned herein for effecting treatment of the light component 108 to produce the synthetic transport diluent 112.

In a further embodiment of the invention, only a portion of the light component 108 may be utilized to produce the synthetic transport diluent 112, leaving a slip-steam of this light component 108 unprocessed. The slip-stream may be combined with the residue component 106 and the synthetic transport diluent 112 to produce the product 114, or may itself be diverted for alternative uses.

Finally, while specific embodiments of the invention have been described and illustrated, such embodiments should be considered illustrative of the invention only and not as limiting the invention as construed in accordance with the accompanying claims.

The invention claimed is:

1. A product obtained from a heavy hydrocarbon feedstock, said product meeting applicable criteria for pipeline transport, said product comprising:

an amount of a residue component separated from said feedstock which includes substantially all asphaltenes of the feedstock, having an API gravity of between about −20° and about 10° and a nickel and vanadium content of 400-600 ppm wt; and an amount of a synthetic transport diluent produced from said feedstock and treated to have an API gravity of between about 20° and about 80°;

wherein the heavy hydrocarbon feedstock has a nickel and vanadium content of 100-400 ppm wt, the product has a nickel and vanadium content of 190-235 ppm wt and the residue component in the product constitutes 25-75% by volume of the product.

2. The product of claim 1, further comprising an amount of an external diluent having an API gravity of between about 20° and about 80°.

3. The product of claim 2, wherein said external diluent has a viscosity of less than about 50 centistokes.

4. The product of claim 1, wherein said product has an API gravity of at least about 19° and a viscosity of no greater than about 350 centistokes.

5. The product of claim 1 wherein said residue component has a viscosity of greater than about 1,000,000 centistokes.

6. The product of claim 1 wherein said synthetic transport diluent has a viscosity of less than about 5 centistokes.

7. The product of claim 1, wherein said residue component separated from said feedstock has an API gravity of between about 0°and about 5°.

8. The product of claim 1, wherein said synthetic transport diluent has an API gravity of at least about 30°.

9. The product of claim 1, wherein said feedstock comprises nickel and vanadium and said nickel and vanadium are concentrated in said residue component.

10. The product of claim 1, wherein said residue component separated from said feedstock is untreated.

11. The product of claim 1, wherein said residue component, after being separated from said feedstock, is employed without treatment.

12. The product of claim 1, wherein said residue component separated from said feedstock is directly incorporated into said product.

13. The product of claim 1, wherein the heavy hydrocarbon feedstock has a nickel and vanadium content of 100-400 ppm wt and the product has a nickel and vanadium content of 84 to 104% of the feedstock.

14. The product of claim 1, wherein the residue component in the product constitutes 34-44% by volume of the product.

* * * * *